United States Patent [19]

Sappington

[11] Patent Number: 4,819,611

[45] Date of Patent: Apr. 11, 1989

[54] ARCHERY BOW FLEXIBLE SIGHT PIN

[76] Inventor: Donald R. Sappington, 504 Highfield, St. Charles, Mo. 63303

[21] Appl. No.: 197,817

[22] Filed: May 23, 1988

[51] Int. Cl.[4] ..... F41G 1/00

[52] U.S. Cl. ..... 124/87; 33/265

[58] Field of Search ..... 124/23 R, 24 R, 87, 124/88; 33/265

[56] References Cited

U.S. PATENT DOCUMENTS

| | | | |
|---|---|---|---|
| 1,620,364 | 3/1927 | Latourell | 33/242 |
| 1,683,106 | 9/1928 | Schrank | 33/242 |
| 2,574,599 | 11/1951 | Stieber | 127/87 X |
| 2,767,472 | 10/1956 | Kocur | 33/265 |
| 3,389,695 | 6/1968 | Roloff et al. | 124/87 X |
| 3,475,820 | 11/1969 | Kernan | 33/265 |
| 3,696,517 | 10/1972 | Larson | 33/265 |
| 4,026,032 | 5/1977 | Smith | 124/87 X |
| 4,584,777 | 4/1986 | Saunders | 33/265 |
| 4,587,945 | 5/1986 | Little | 124/87 |
| 4,757,614 | 7/1988 | Kudlacek | 124/87 X |

OTHER PUBLICATIONS

Cobra Manufacturing Co., Bixby, Okla., Catalog 02.

*Primary Examiner*—Dave W. Arola
*Assistant Examiner*—John A. Ricci
*Attorney, Agent, or Firm*—Paul M. Denk

[57] ABSTRACT

A flexible sight pin for an archery bow sighting device is disclosed in which the flexible sight pin is mounted to the body of the sighting device to permit universal flexing movement of the sight pin upon encountering a force of greater magnitude. The flexible sight pin includes a first portion attached to the body of the sighting device, a second portion constituting an elongated flexible element connected at one end thereof to the first portion and also to a third portion on the opposite end of the second portion. The third portion terminates in an archer's sight at the free end of the flexible sight pin.

8 Claims, 1 Drawing Sheet

ARCHERY BOW FLEXIBLE SIGHT PIN

BACKGROUND OF THE INVENTION

This invention relates to a flexible sight pin, and more particularly, to a flexible sight pin for an archery bow sighting device.

Professional archery bows are commonly provided with sighting devices to enable the professional archer to accurately sight the contemplated target. A variety of sighting devices have been developed. Unfortunately, however, only certain types of sighting devices have been commercially employed. Most of the commercially employed sighting devices include a series of horizontally extending sight pins which are mounted to a bow sighting device and are positioned one above the other in parallel relationship for sighting targets at different distances.

All of the sight pins for hunting or target sights currently in use today constitute rigid, inflexible sighting pins. Examples of such sighting pins are shown in U.S. Pat. Nos. 3,475,820; 3,696,517; 4,584,777; 1,683,106; 1,620,364; 3,389,695; 2,767,472; 2,574,599; and, 4,587,945. While such sighting pins have functioned well in enabling an archer to accurately sight the anticipated target, it is necessary to employ a guard surrounding the sight pins to protect them from damage, if struck by a limb or other immovable object. When this occurs, it is usually necessary to straighten or replace the pins, which unfortunately requires a substantial amount of time for "sighting in" the bow again. Thus, it will be appreciated that currently used inflexible sight pins require additional protective components, are difficult to keep in proper adjustment, and require replacement when damaged.

SUMMARY OF THE INVENTION

Among the several objects and features of this invention may be noted:

The provision of a new and improved flexible sight pin for an archery bow sighting device;

The provision of such a flexible sight pin which provides universal flexibility when contacted by a force of greater magnitude from any direction;

The provision of such a flexible sight pin which permits flexing of as much as 90°, with return to its original position, without the need to subsequently adjust or align the pin or "sight-in" the bow again;

The provision of such a flexible sight pin which eliminates the need for a costly separate pin guard, thus reducing the overall cost of the archery bow sighting device; and The provision of such a flexible sight pin which is simple and easy to fabricate, is economical, is easy to install and maintain, has little or no maintenance, is highly efficient, utilizes a minimum number of parts, and is otherwise well adapted for the purposes intended.

Briefly stated, in the present invention, a flexible sight pin for an archery bow sighting device is provided, in which the flexible sight pin is mounted to the body of the sighting device, and the flexible sight pin is attached to and extends from the sighting device body. The flexible sight pin comprises a first portion attached to the body, a second portion including an elongated flexible element which is connected to the first portion at one end and to a third portion at an opposite end. The third portion terminates in an archer's sight at an outer free end of the flexible sight pin. The second portion, including the elongated flexible element thereof, provides universal flexing of the elongated flexible element of the sight pin when the sight pin is contacted by a force of greater magnitude. Such portion, including all portions may be fabricated of spring or resilient steel, other metal, plastic, or even rubber.

Other objects and features of this invention will become apparent from the ensuing description.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
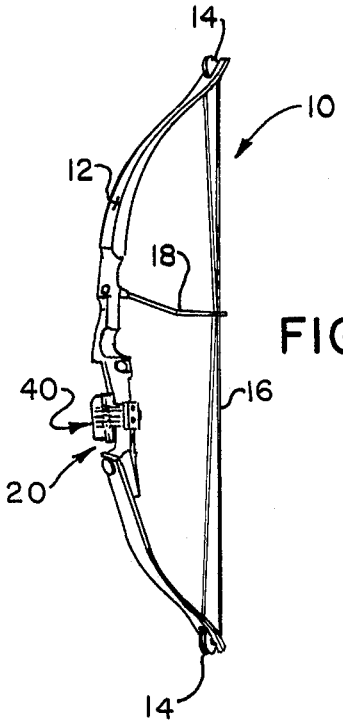
FIG. 1 is an isometric view of a typical professional archery bow including the flexible sight pin for an archery bow sighting device which is constructed in accordance with the teachings of the present invention.

The professional archer's bow 10 shown in FIG. 1 of the drawings includes a curved bow 12 having idler pulleys 14 at the free end thereof over which is entrained the bow string 16, as illustrated. The cable or string guard 18 extends from the curved bow 12 and holds the cable or string 16 as shown in the drawings, to enable an arrow to employ the force of both sides or runs of the cable 16 in the archery bow 10. Of course, a single stringed archery bow may be used, if desired The present invention is directed to the archery bow sighting device 20 in which a plurality or series of flexible sight pins 40 are mounted, in order to enable an archer to utilize one or more of the sight pins 40 in sighting an anticipated target. Currently, the sight pins comprise rigid, inflexible sight pins which not only require a protective guard to protect them from damage, but they are also difficult to keep in proper adjustment, and they require replacement when damaged. The flexible sight pin of this invention can replace most of these rigid pins, and fit most sight pins on the market.

As an important feature of the present invention, flexible sight pins 40 are mounted to the archery bow sighting device 20, to enable universal flexibility of the sighting pins when encountering a force o greater magnitude, such as a tree limb or other movable object.

Thus, the flexible sight pins are able to "snap-back" to their original position as shown in the drawings. The need for a protective pin guard has been eliminated, and the problems of keeping the pins in proper adjustment as well as replacing damaged pins has been overcome, by the present invention.

The flexible sight pins 40 are preferably mounted relative to an archery bow sighting device 20 as shown in the drawings. The archery bow sighting device preferably includes an upwardly opening channel-shaped 22 having opposed shoulders 24, 24 which overhang the channel at the open end thereof. Each of the flexible pins 40 are mounted relative to a body or block 26 which is adjustably mounted relative to the channel-shaped member 22. Specifically, the body 26 includes a cylindrically-shaped channel guide 28 which is received within a corresponding opening 30 of the body 26. At the lower end of the channel guide 28, there is provided a foot or flange 32 which is arranged to be positioned below the opposed shoulders 24, 24 of the member 22. A threaded screw 34 is received within the opening 35 of the body 26, which communicates with the opening 30 of the body 26, in order to enable the threaded screw 34 to be threaded in complementary mating engagement with an internally threaded opening 36 in the channel guide 28, as shown in the drawings. By tightening the threaded screw 34, the channel guide 28 has its foot or flange 32 drawn into contact with the under surfaces of the opposed shoulders 24, 24 of the channel-shaped member 22. In this way, the body or block 26 of the archery bow sighting device 20 can be positioned along the channel-shaped member 22 in various locations in order to position the flexible sight pins 40 carried thereby, as may be desired.

It will be appreciated that the flexible sight pins 40 may be mounted in archery bow sighting devices or the like having various constructions, and thus the archery bow sighting device 20 in various forms has been incorporated in earlier structures, but has been described for illustrative and environment purposes herein. In the discussion that is to follow, attention will be focused solely on the flexible sight pins 40 and the manner in which such sight pins are mounted relative to a body of an archery bow sighting device or the like.

Each of the flexible sight pins 40 have a first portion 42, a second portion 44, and a third portion 46. The first portion 42 includes an externally threaded section 48 and an unthreaded section 50. The externally threaded section 48 of the first portion 42 is complementary threaded relative to an internally threaded bore 38 provided in the body or block 26 for mating engagement therewith. When used with the channel guide 28 as shown in the drawings, a corresponding opening 52 is provided in the channel guide 28 for receiving the threaded section 48 of the first portion 42, as is illustrated in the drawings.

Figure 4:
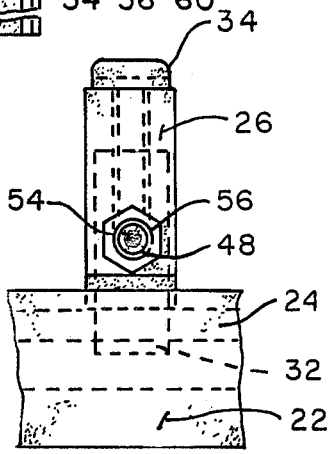
FIG. 4 is a fragmentary end elevational view of the archery bow sighting device mounted to the archery bow.

The externally threaded section 42 of the first portion 48 extends through the body or block 26 and projects beyond the opposite side thereof in order to receive a nut member 54 which is threaded upon the externally threaded section 48. As shown in FIG. 4, a polygonal opening 56, which is hexagonally shaped, is provided in the free end of the threaded section 48, for receiving an Allen wrench. Alternatively, a slot may be formed in the end of the threaded section 48, for receiving a screw driver or the like. Through the use the polygonal opening 56 or a slot (not shown), the threaded section 48 can be rotated while the locking nut 54 is tightened in position, for adjusting the flexible sight pin 40. In certain cases, it may be desirable to also rotate the locking nut, while rotating the externally threaded section 48 of the first portion 2, in adjusting the flexible sight pin 40 relative to the archery bow sighting device 20.

The integral unthreaded section 50 of the first portion 42 has an external diameter sufficient to provide press fit engagement with a cooperating through opening provided in the second portion 44. The second portion 44 comprises an elongated flexible element in the form of a series of tightly wound spring convolutions 56, and the helically wound or convoluted spring sections 56 have a through opening 58 into which the unthreaded section 50 of the first portion 42 is inserted at one end of the second portion 44. The through opening 58 receives the unthreaded section 50 of the first portion 42 such that the tightly wound helical or spring convolutions 56 grip upon and provide the desired press fit engagement therewith.

At the opposite end of the second portion 44, a third portion 46 is inserted into the through opening 58. The third portion 46 includes a connecting section 60 having an external diameter similar to the external diameter of unthreaded section 50, in order to allow the third portion 46 to be received in press fit engagement within the through opening 58 of the second portion 44. The third portion 46 further includes an archer's sight section 62, including a ball tip 64 at the outer free end of the flexible sight pin 40 for sighting the anticipated target.

Figure 2:
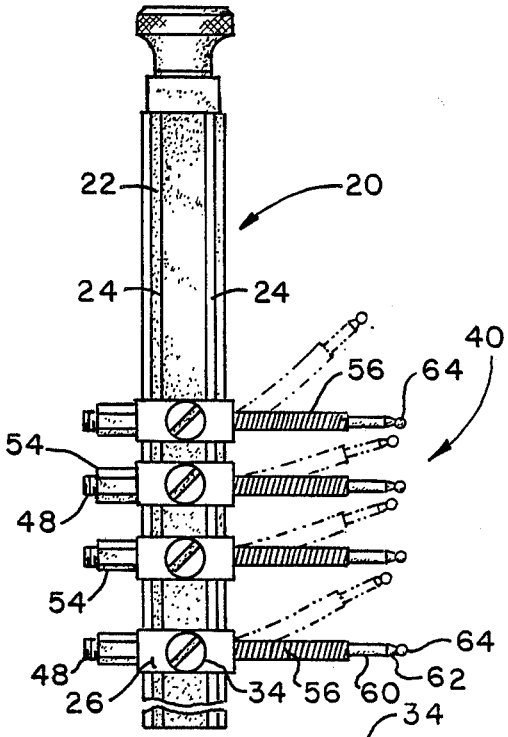
FIG. 2 is a top plan view illustrating, by the full line representations, the manner in which the flexible sight pins are mounted to the archery bow sighting device, and also showing by the phantom line representations the manner in which the flexible sight pins have universal flexibility when encountering a force of greater magnitude.
Figure 3:
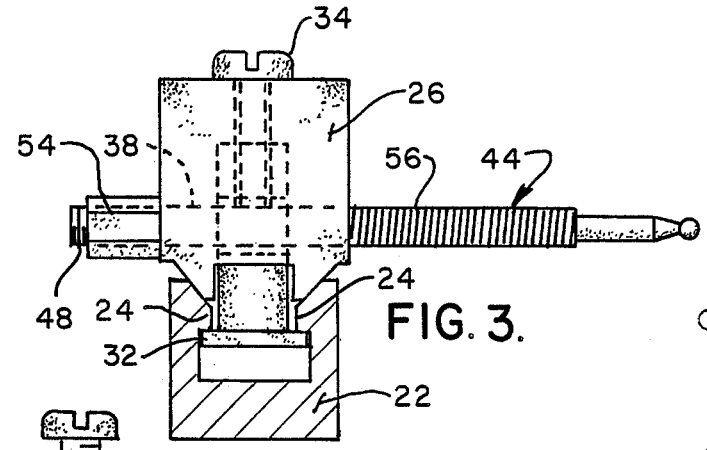
FIG. 3 is a side elevational view, partly in section, illustrating the relative position and mounting of each flexible sight pin relative to the archery bow sighting device.
Figure 5:
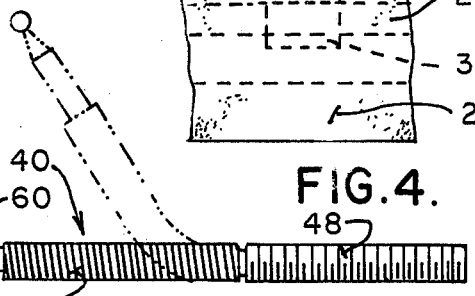
FIG. 5 is an enlarged side elevational view of the flexible sight pin showing its normal unflexed position in full line, and its ability to permit universal flexibility as illustrated by the phantom lines.
Figure 6:
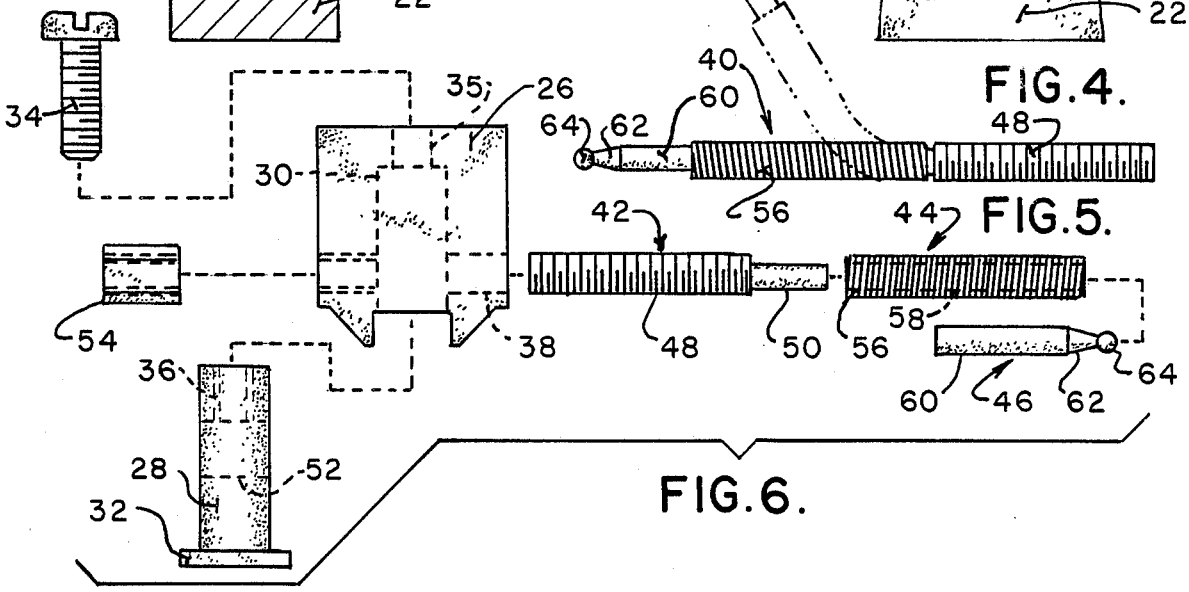
FIG. 6 is an exploded side elevational view showing the various components of the flexible sight pin together with its mounting relative to the archery bow sighting device.

When the first, second and third portions 42, 44, and 46 respectively of the flexible sight pin 40 are assembled to one another as shown in FIG. 5 of the drawing, the elongated flexible second portion 56 is capable of being flexed as shown, while the threaded section 48 of the first portion is maintained in fixed and stable relationship relative to the body or block 26 of the archery bow sighting device 2. Further, even as the elongated flexible second portion 56 is flexed out of its normal position as illustrated in the phantom lines in FIGS. 2 and 5 of the drawings, the third portion 46 including the ball tip archer's sight 65 is maintained relative to the end of the elongated flexible second portion 56, in order that it will resume its original position, when the elongated flexible second portion 56 "snaps-back" to its original position as shown in FIG. 5 of the drawings.

Accordingly, it can be seen that a new and improved flexible sighting pin for an archery bow sighting has been provided. The flexible sighting pin provides universal flexibility when encountered by a force of greater magnitude, even flexing as much as 90°, with return to an original position, without subsequent re-adjustment or replacement of a sighting pin.

It must further be commented that while the flexible sight pin device of this invention is shown, as in FIG. 1, being mounted extending laterally of the bow, and in its preferred embodiment generally extends from the right side of the bow, for a right-handed bow, so that as sighting is done, the bow need not be shifted from its sighted and adjusted position before a shot of the arrow is made. On the other hand, it is just as likely that the sighting device of this invention may likewise extend from the left side of an archery bow, as when used by a left-handed archer, in order to conveniently accommodate its application under such circumstances. In any event, because of the bulk associated with many of the sighting pin devices of the prior art, which likewise included a peripheral guard, in the construction, in order to adequately safeguard the adjusted, but inflexible pins, such bulk in constructive components tended to develop a blind spot for the archer, and therefore necessitated the locating of the sighting device upon the side of the bow opposite from that other side from which the archer conducts his shot of the arrow. As a result, once the archer would focus and adjust the inclination of his bow with respect to the target in sight, since the sight pins were located on the opposite side of the bow, the archer then had to shift his bow, ever so slightly, to the opposite side, before conducting a shot. This has caused inaccuracies in focusing, and is remedied by the type of sighting device as described herein, and employed as this invention.

In view of the above, it will be seen that the several objects of the invention are achieved and other advantageous results are obtained.

As various changes could be made in the above constructions without departing from the scope of the invention, it is intended that all matter contained in the above description or shown in the accompanying drawing shall be interpreted as illustrative and not in a limiting sense.

Having thus described the invention what is claimed and desired to be secured by Letters Patent is:

1. A flexible sight pin for an archery bow sighting device in which the flexible sight pin is mounted to the body of the sighting device, said flexible sight pin being attached to and extending from said body, said flexible sight pin comprising a first portion attached to said body, a second portion including an elongated flexible element which is connected to said first portion at one end thereof and to a third portion at an opposite end, said third portion terminating in an archer's sight at an outer free end of said sight pin, said second portion providing universal flexing of the elongated flexible element thereof when the sight pin is contacted by a force.

2. The flexible sight pin as defined in claim 1 wherein the first portion of said flexible sight pin includes threaded and unthreaded sections, said threaded section being adapted for complementary threaded engagement with an internally threaded bore in said body, and said unthreaded section having an external diameter sufficient to provide press fit engagement with a cooperating through opening provided in said second flexible portion.

3. The flexible sight pin as defined in claim 2 wherein the third portion of said flexible sight pin includes a connecting section and an archer's sight section, said connecting section having an external diameter sufficient to also provide press fit engagement with the cooperating through opening in said second flexible portion, and said archer's sight section including a ball tip at the outer free end of said flexible sight pin for sighting the anticipated target.

4. The flexible sight pin as defined in claim 3 wherein said second portion comprises a series of tightly wound spring convolutions providing the aforementioned press fit engagement with said first and third portions, while permitting the desired universal flexing of said flexible sight pin.

5. The flexible sight pin as defined in claim 4 wherein the first portion of said flexible sight pin includes adjusting means associated therewith for adjusting the amount of extension of said flexible sight pin from said body.

6. The flexible sight pin as defined in claim 5 wherein the threaded section of said first portion extends beyond said body on an opposite side from which said flexible sight pin extends, said first portion further being provided with a tool receiving opening for receiving a wrench or the like at a free unconnected end thereof, and a nut member for complementary threaded engagement with the threaded section of said first section beginning with the free unconnected end thereof, whereby said tool receiving opening and/or said nut member provides rotatable adjustment of said flexible sight pin relative to said body.

7. In an archery bow sighting device for mounting to an archery bow and having a body mounted to the archery bow from which at least one sight pin extends, wherein the improvement comprises; an elongated flexible sight pin attached to and extending from said body, said elongated flexible sight pin having a first portion attached to said body, a second portion including an elongated flexible element connected to said first portion at one end and connected to a third portion on an opposite end thereof, said third portion including an archer's sight at the free outer end of said sight pin, said second portion through its elongated flexible element providing universal flexing of said sight pin when contacted by a force.

8. The improvement as defined in claim 7 wherein the first portion of said flexible sight pin includes threaded and unthreaded sections, said threaded section being adapted for complementary threaded engagement with an internally threaded bore in said body, said unthreaded section having an external diameter sufficient to provide a press fit engagement with the cooperating through bore in said second portion, said third portion having a connecting section and an archer's sight section, said connecting section having an external diameter sufficient to also provide press fit engagement with the cooperating through opening in said second portion, said archer's sight section including a ball tip at the free end of said flexible sight pin for sighting the anticipated target, and said second portion having a series of tightly wound spring convolutions providing the aforementioned press fit engagement with said first and third portions, while permitting the desired universal flexing of said flexible sight pin.

* * * * *